US006606826B2

(12) United States Patent
Nagle

(10) Patent No.: US 6,606,826 B2
(45) Date of Patent: Aug. 19, 2003

(54) INFLATABLE WORK SHELTER

(76) Inventor: Ian Gerard Nagle, Lackin House, Middle Glanmire Road, Cork, County Cork (IE)

( * ) Notice: Subject to any disclaimer, the term of this patent is extended or adjusted under 35 U.S.C. 154(b) by 129 days.

(21) Appl. No.: 09/816,147

(22) Filed: Mar. 26, 2001

(65) Prior Publication Data

US 2002/0023390 A1 Feb. 28, 2002

Related U.S. Application Data

(63) Continuation of application No. PCT/IE99/00101, filed on Sep. 27, 1999.

(30) Foreign Application Priority Data

Sep. 25, 1998 (IR) ..... S980796

(51) Int. Cl.[7] ..... E04B 1/34; E04G 11/04; E04H 15/20

(52) U.S. Cl. ..... 52/2.18; 52/2.19; 52/DIG. 12; 52/DIG. 14; 135/87; 135/900

(58) Field of Search ..... 135/87, 900; 52/66, 52/86, 2.11, 2.17, 2.18, 2.19, DIG. 12, DIG. 14

(56) References Cited

U.S. PATENT DOCUMENTS

| | | | |
|---|---|---|---|
| 2,955,606 | A | 10/1960 | Walker et al. |
| 3,973,363 | A | 8/1976 | LaPorte et al. |
| 4,192,105 | A | 3/1980 | Morgan |
| 4,959,901 | A | 10/1990 | Parish |

*Primary Examiner*—Robert Canfield
(74) *Attorney, Agent, or Firm*—Birch, Stewart, Kolasch & Birch, LLP

(57) ABSTRACT

An inflatable temporary work shelter. In one embodiment, the shelter has an inflatable framework and a covering material. In a second embodiment the shelter could be formed of inflatable panels. The shelter includes a spine formed between two separate bearing frame members which, on inflation, contact each other. When inflated, for example, from a position beneath a structure such as an aeroplane wing suspending an engine pod by a pylon, the shelter will initially impinge against the engine pod and because the shelter is not fully inflated the spine will open and allow the shelter to continue to rise until fully inflated when the spine will be light on the pylon and the shelter will contain the engine.

36 Claims, 12 Drawing Sheets

INFLATABLE WORK SHELTER

Figure 3:
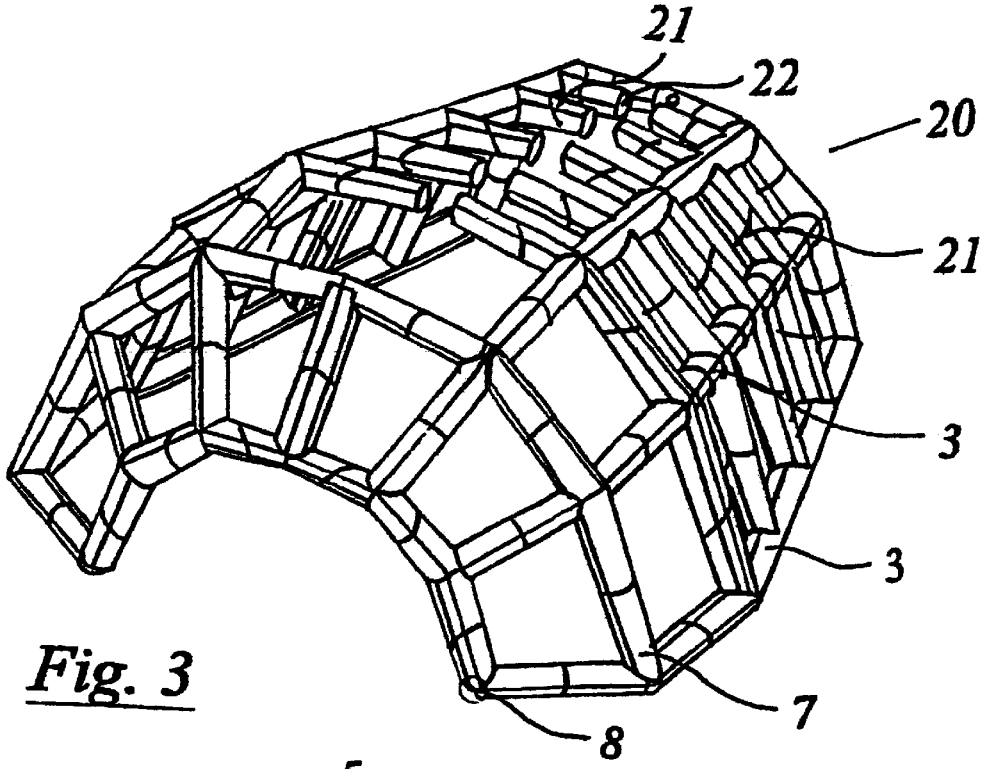

This application is a continuation of PCT/IE99/00101 filed Sep. 27, 1999.

The present invention relates to inflatable work shelters for another structure and in particular to temporary shelters for use in the maintenance of aircraft engines in the open, or for use with other equipment and units.

One of the major problems with aircraft engine maintenance is that very often the aircraft engine has to be repaired in situ. This may be because either there is not hangar space available, or, for example, the particular airline as is becoming the normal practice has flown their own maintenance crew out to maintain or replace the engine, whose own maintenance crew does not have covered facilities or hangars to store the aircraft for maintenance, or alternatively, the cost of such storage is prohibitive. There is thus a need for a temporary structure that would cover portion of the aircraft to at least encapsulate the engine pod below the wing to which it is attached giving sufficient covered spaced beneath the wing to allow the maintenance staff to work thereon in reasonable comfort.

It has always been appreciated that it would be virtually impossible to build any temporary structure around and beneath the wing of the aircraft which would achieve this function because of the relatively high winds and adverse conditions encountered in airports. The amount of damage that could be caused by such a structure being blown over or falling could be considerable. The damage might not alone be to the aircraft to which it was attached or mounted beneath, but to adjoining aircraft and even more importantly to personnel. Thus, it has been considered heretofore as being relatively impossible to provide such a structure.

Similar problems arise with equipment attached to the outside of buildings or other structures. Equipment such as switchgear, boilers, power units and meters for services are often for safety, access and other reasons placed outside buildings. The enclosures, if any, in which they are placed are often insufficient to provide protection from the elements for those working on them.

The problem has been appreciated particularly for construction projects that are being built under extremely adverse environmental conditions of, for example, building gas and oil pipelines across difficult terrain. It has been appreciated for many years that one of the best ways of providing such protection is to use some type of inflatable portable structure or shelter which could be used by personnel working under such conditions. The advantage of this is that as the particular building or unit is constructed the shelter can be deflated and removed to another site. Indeed it has been known to provide such inflatable shelters for fishermen and some maintenance personnel. A typical example of such a structure is described in U.S. Pat. No. 4,192,105 (Morgan). However, to provide such an enormous structure to enclose a whole aircraft would be virtually an impossible task and thus heretofore it has been considered that even if temporary structures were required that inflatable shelters would be inappropriate in situations such as that envisaged above namely for the maintenance of aircraft engines in situ where shelter around the aircraft appears to make it totally impractical in use.

The present invention is directed towards providing an inflatable shelter for mounting beneath the wing of an aircraft to at least encapsulate an engine pod, but also for mounting against or beneath another structure to enclose portion of it to provide protection from the environment for equipment and personnel when work is being cared out on the structure.

Ideally such a shelter should also be capable of being used as a free standing enclosed shelter or building in its own right when not attached to another structure.

Indeed the invention is also directed towards providing temporary structures generally.

STATEMENT OF INVENTION

According to the invention there is provided an inflatable temporary work shelter for another structure, the shelter comprising walls, at least portion of which are inflatable to provide a free standing shelter characterised in that the walls define an open structure embracing spine having side edges urged on inflation towards each other into a closed position with portion of the structure enclosed therein. The advantage of this is that as well as the inflatable shelter only having to be sufficiently large to encapsulate the portion of the structure that it is desired to work on, it also has the advantage of using the structure to partially anchor it in position. By the spine engaging an embracing portion of the structure, the inflatable nature of the shelter ensures a close contact between the side edges of the spine and the structure thus providing a seal preventing the ingress of dirt, moisture and other contaminants. Thus an enclosed shelter can be provided and if it is necessary to provide heating, air conditioning or the like within the shelter, this can be readily easily provided in an energy efficient manner.

Ideally, the side edge faces are urged on inflation to contact the structure. By having the side edge faces contact the structure suitable anchorage and sealing from the ingress of dirt and moisture or indeed the prevention of, for example, the outflow of hot air will be readily easily achieved. Ideally, portion of the side edge faces contact each other on inflation to surround part of the structure. In one embodiment of the invention, portion of the side edge faces contact each other intermediate their ends to accommodate portion of the structure projecting therethrough.

Ideally the walls comprise a framework formed by inflatable interconnected frame members and a covering material attached thereto, the spine being provided by two adjacent facing bearing frame members. This particular structure is very useful as the facing bearing frame members will form a tight grip against the structure.

Ideally, the spine member comprises a pair of arcuate elongate facing bearing frame members forming on inflation a structure receiving hole, the side faces being urged on inflation to contact the structure. This can be a particularly advantageous arrangement where, for example, an aeroplane has an engine pod which is not, for example, suspended from the engine wing by a pylon but is in effect formed substantially integral with the wing. In this case it is necessary to inflate the structure so that it can encompass the whole of the engine pod and bear up against the underneath portion of the wing. This could be particularly important, for example, where the engine includes cowling of the gull-wing type which cowling when open lies along the underneath the wing and thus the hole might have to be sufficiently large to accommodate not just simply the engine itself but also be sufficiently wide as to allow the cowling lie within the shelter or alternatively for the structure to lie or bear up against the underneath of the gull-wing cowling.

Ideally each bearing frame member includes at least one hinge portion intermediate its length for limited pivotal movement about itself. The advantage of this is that the side edges of the spine will accommodate irregularities and changes in shape of the structure against which it is mounted thus providing an even closer contact between the side edges of the spine and the structure than if no hinges were provided.

In one embodiment of the invention, each bearing frame member comprises a plurality of separate frame members interconnected by extension sheet material to permit extension of the peripheral dimensions of the spine portion to accommodate the structure. Again the advantage of this is that, as will often be the case, the structure to which the shelter is being attached will be relatively large and thus the spine opening might not of itself be sufficient to encapsulate the portion of the structure. This will allow greater flexibility in mounting.

Ideally the two bearing frame members are configured to contact each other firmly on inflation when the structure is not encapsulated therein. The advantage of this is that the shelter, when not used in conjunction with another structure, will form an enclosed shelter or building in its own right.

In one embodiment of the invention, the spine comprises a pair of elongate in-line transverse frame members, each frame member terminating in an end portion bearing against one of the side edge faces, the two end portions facing each other from opposite side edge faces. The advantage of this construction is that the spine forming frame members will, as it were, bear tightly against a structure providing further anchorage and sealing of the side edges of the spine against the structure.

Ideally, the spine is located against the uppermost portion of the shelter when inflated whereby on being placed beneath a structure and inflated the shelter will contact the underneath of the structure and force the side edge faces apart to encompass portion of the structure.

Ideally, the shelter comprises elongate frame members of substantially tubular flexible material and having on the exterior thereof anchorages, and a connecting means for securing in line anchorages together to varying the length of the frame member. The advantage of this is that it is possible to accommodate different heights of plane wing, for example, when the shelter is used in conjunction with engine maintenance.

Ideally the side edges of the spine incorporate a resilient material which resilient material is preferably a foamed plastics material. It will be appreciated that sealing the side edges of the spine against the structure will be advantageous.

In one embodiment of the invention, peripherally arranged extension walls of flexible material are provided to accommodate different heights of structure above the ground. It will be appreciated that, for example, if the shelter according to the present invention is used with various aeroplanes that by virtue of the different constructions of airplane that the height of the airplane wing above the ground will vary and thus the shelter may have to accommodate many sizes and heights of airplane engine above the ground. This equally well applies to other structures. By providing, as it were, planar walls on the lower portion of the shelter, it is possible to accommodate such height variations.

Ideally the side walls incorporate containers for ballast anchoring material which generally will be water. This is particularly advantageous because as well as anchoring the shelter against the structure by means of the spine and its side walls gripping the structure, further anchorage is provided. This will be particularly important where it would not be possible to, for example, insert anchorage spikes or the like into the ground to secure the shelter in position.

In one embodiment of the invention, there is provided connections on the exterior thereof for connection to stay wires. This can be particularly advantageous in situations where high winds can be encountered. The stay wires can be anchored, for example, by any suitable weights on a runway such as sandbags.

It will be appreciated that ideally the walls are substantially arcuate in shape and the spine forms a central ridge for enclosing an aircraft engine pod mounted on the aircraft wing. One of the major advantages of the shelter according to the present invention when used with an aircraft engine or the like structure which is spaced apart above the ground is that the inflatable shelter can be placed beneath, for example, the engine pod, inflated until the spine is directly below the engine pod so that the spine will then engage the pod and on further inflation will slide as it were around the pod to engage over the engine pod on portion of the wing structure. While in many instances a certain amount of manipulation of the shelter around the engine pod may be necessary it will not always be the case and indeed it is envisaged that one person could inflate the shelter and anchor it securely against an aircraft engine pod, the shelter being effectively self locating.

In one embodiment of the invention, it is envisaged that it would be advantageous to provide a plurality of deflation valves adjacent the spine. Since the shelter will encompass and lie over in many instances considerable portions of another structure a problem could arise on deflation in that the shelter would collapse on top of the other structure with portions of it still inflated and be prevented from deflation by pressure, as it were, from part of the other structure bearing against it. It is thus envisaged that additional deflation valves may be required and indeed it is envisaged that such deflation valves may be remotely operated.

In one embodiment of the invention, the shelter walls comprise four upstanding substantially rectangular side walls and a flat covering wall providing a roof and a spine extending from one side wall across the roof to the opposite side wall for an aircraft wing to project therethrough. This is a particularly suitable construction for use with engine pods and aeroplanes where the engine pod is substantially flush with the aeroplane wing.

DETAILED DESCRIPTION OF THE INVENTION

Figure 1:
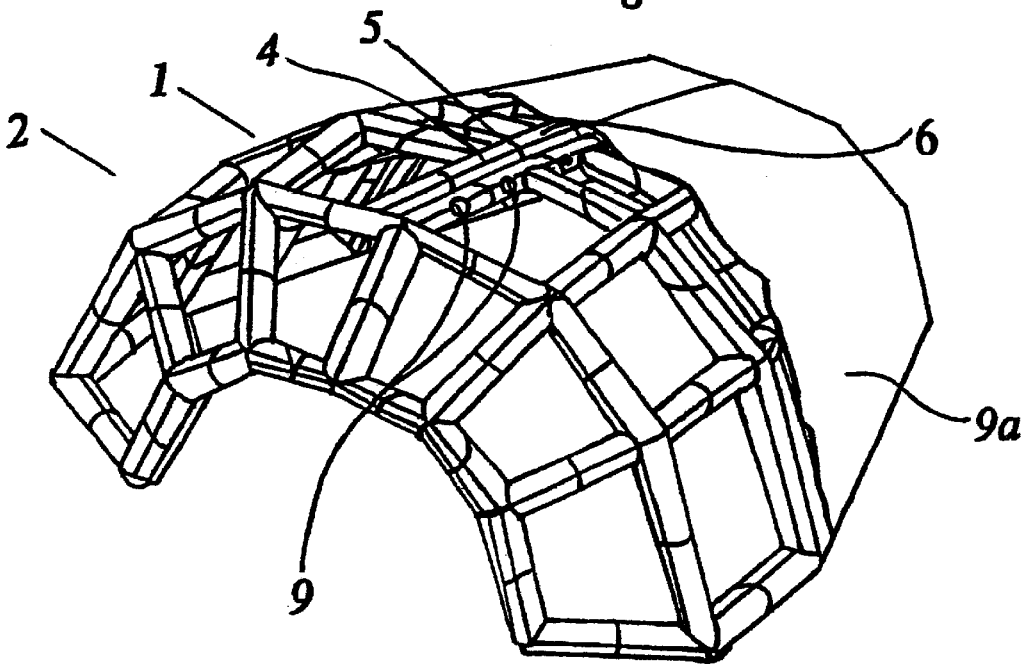
Figure 2A:
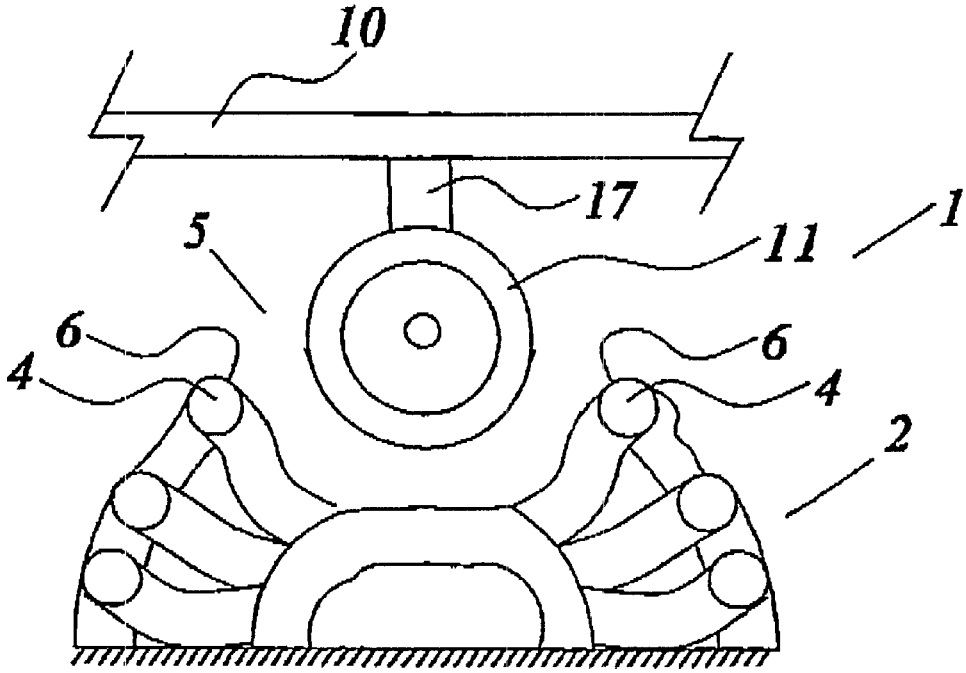
Figure 2D:
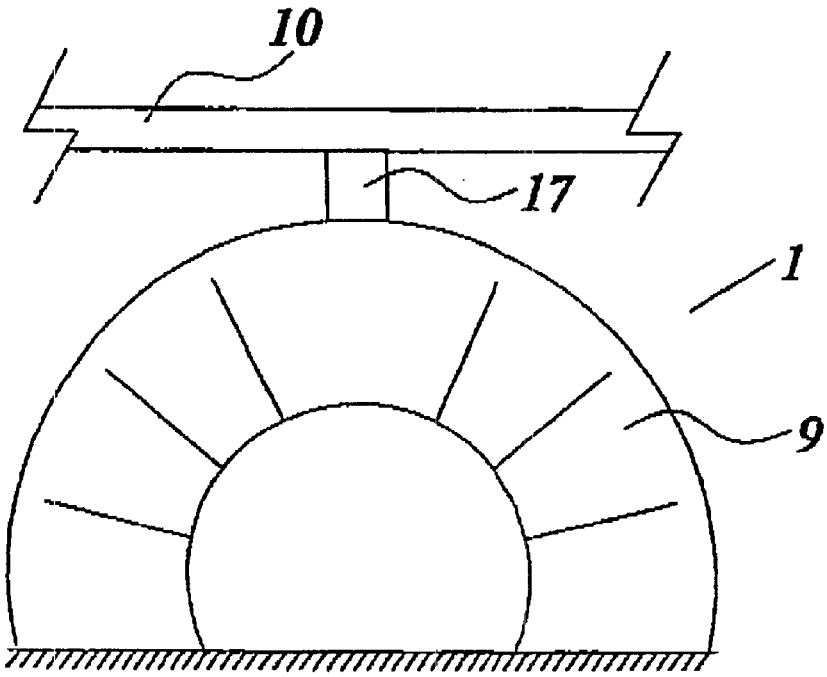
Figure 2C:
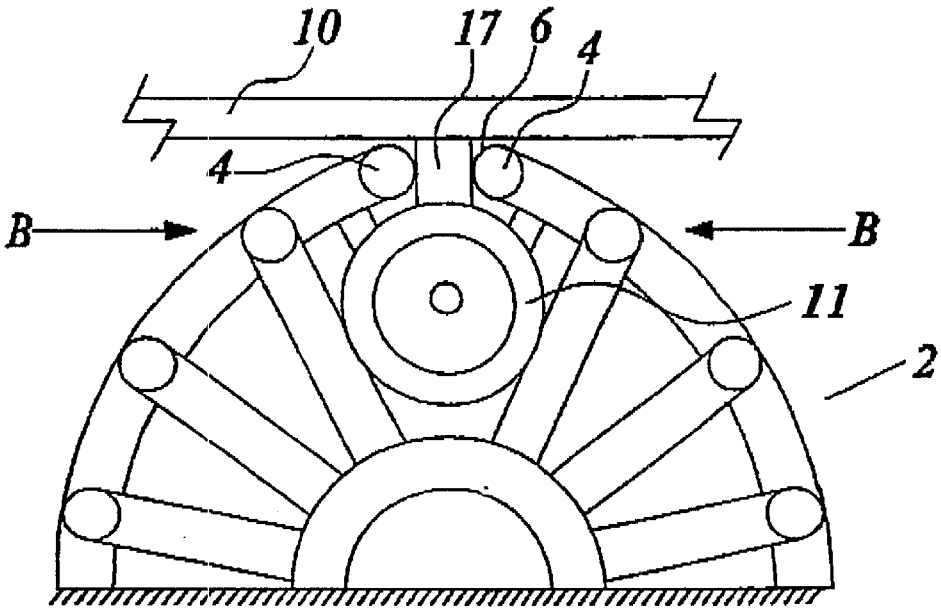
Figure 2B:
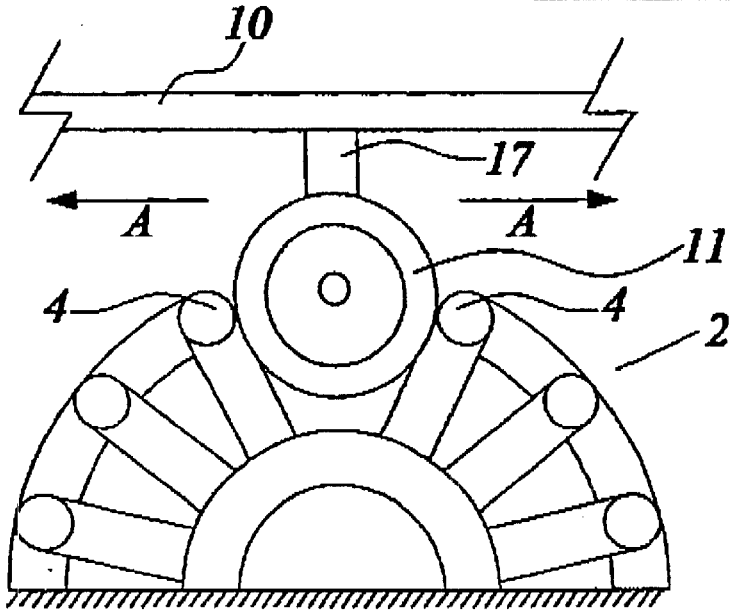
Figure 9:
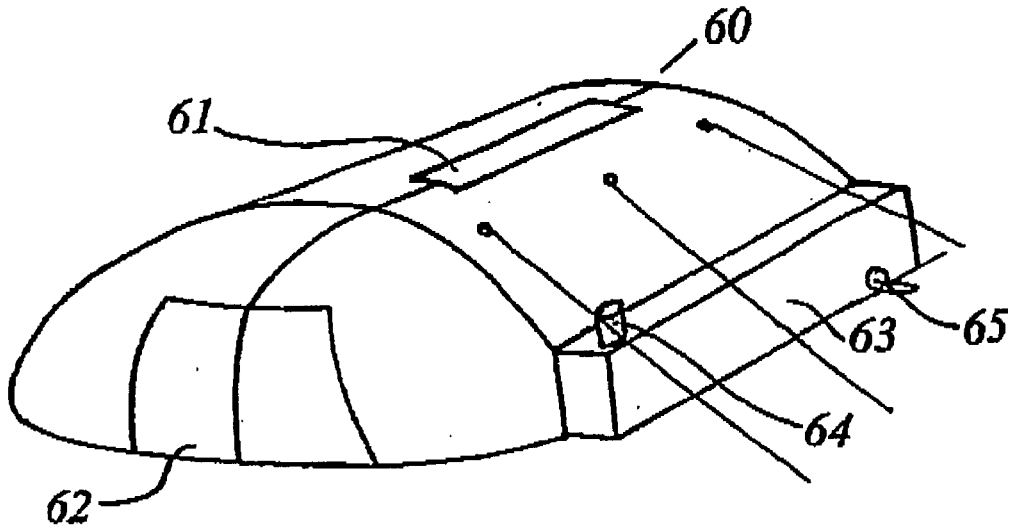
Figure 4:
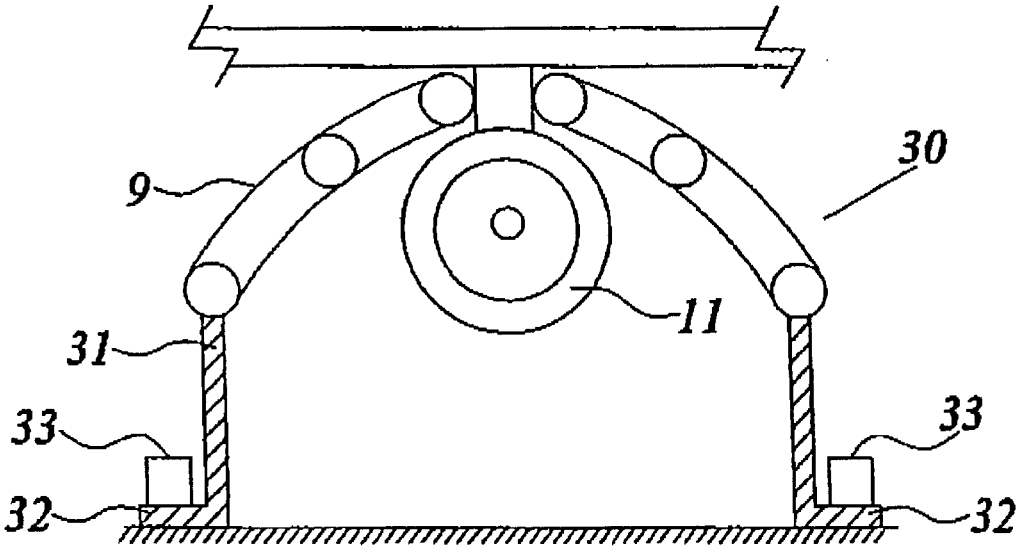
Figure 5:
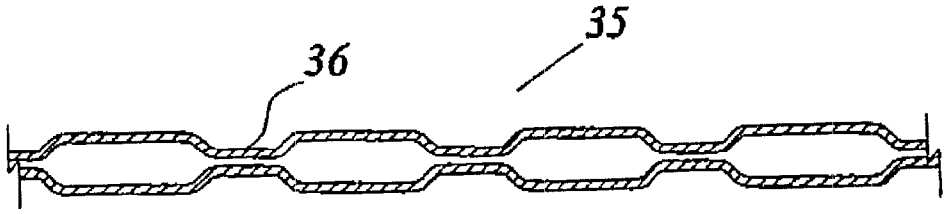
Figure 6:
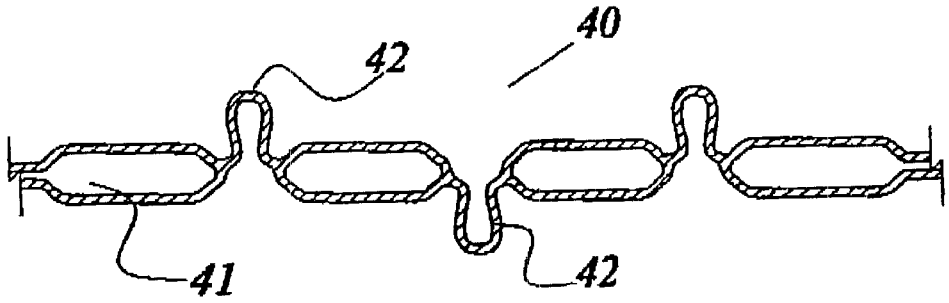
Figure 7:
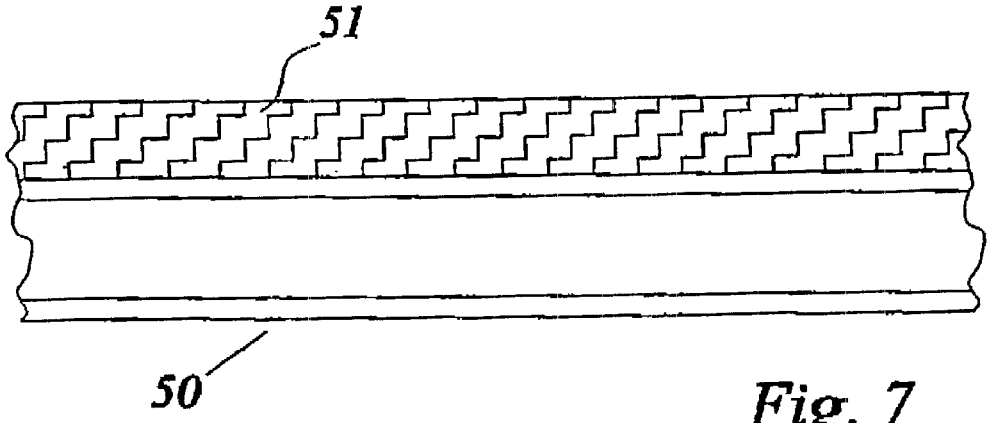
Figure 8:
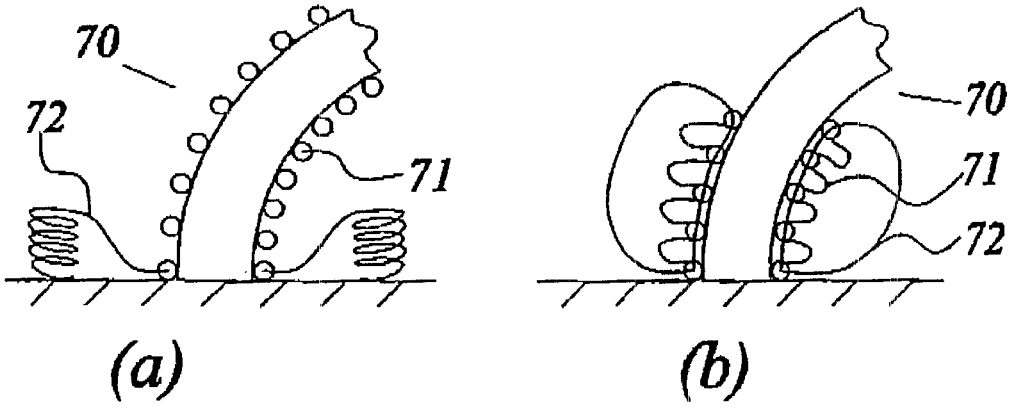

The invention will be more clearly understood from the following description of an embodiment thereof, given by way of example with reference to the accompanying drawings in which:

FIG. 1 is a perspective view of an inflatable shelter with part of the cover removed;

FIGS. 2(*a*) to (*d*) show in diagrammatic sectional form assembly of the shelter;

FIG. 3 is a perspective of another construction of framework;

FIG. 4 is a view similar to FIG. 2(*d*) showing an alternative construction of shelter according to the invention, FIG. 5 is a sectional view of portion of a frame member forming part of the invention, FIG. 6 is a sectional view of a still further alternative construction of frame member, FIG. 7 is a sectional view of a still further frame member, FIGS. 8(*a*) and (*b*) are side views of another frame member and FIG. 9 is a perspective view of an alternative construction of shelter according to the invention.

Figure 10:
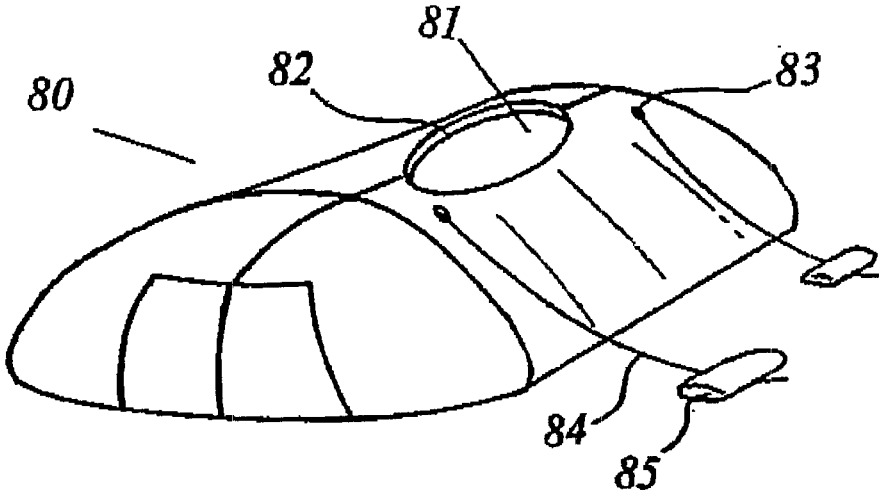
Figure 11:
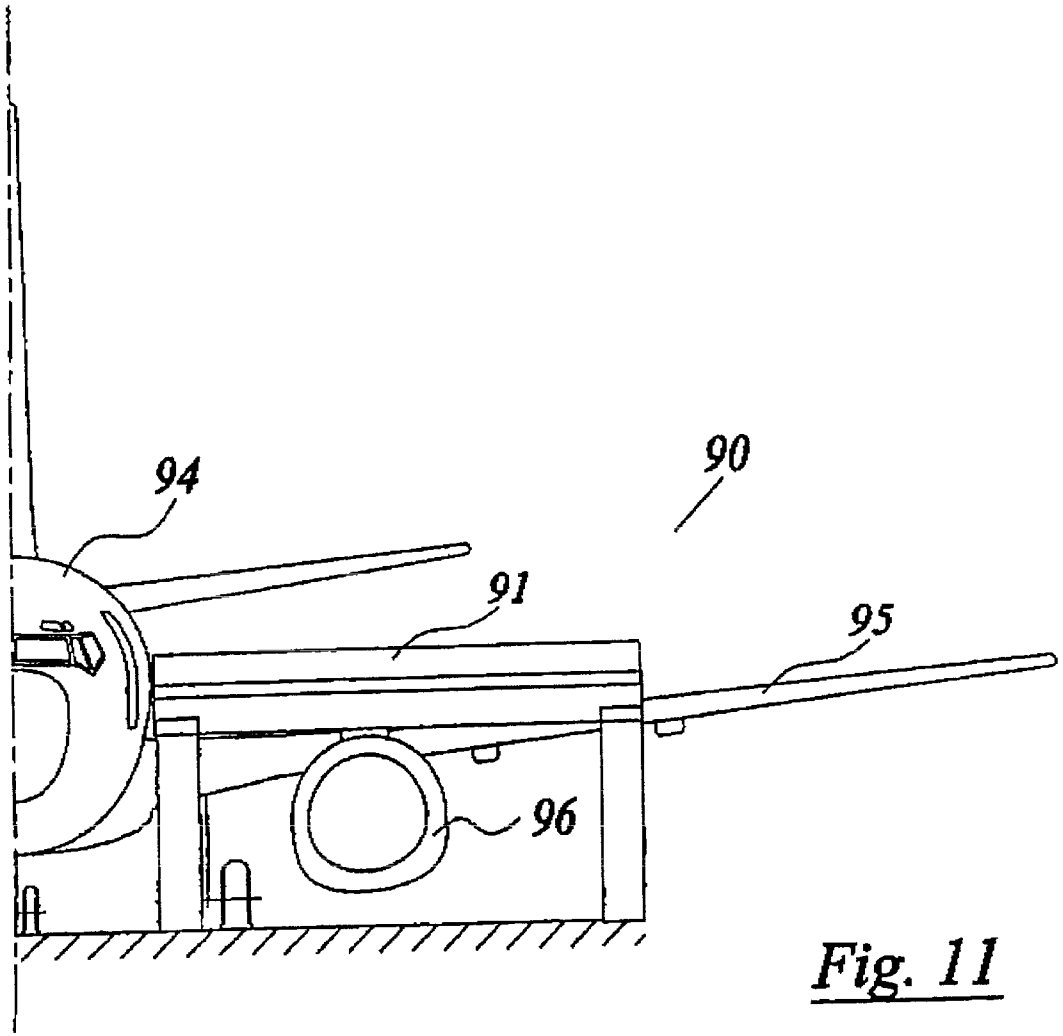
Figure 12:
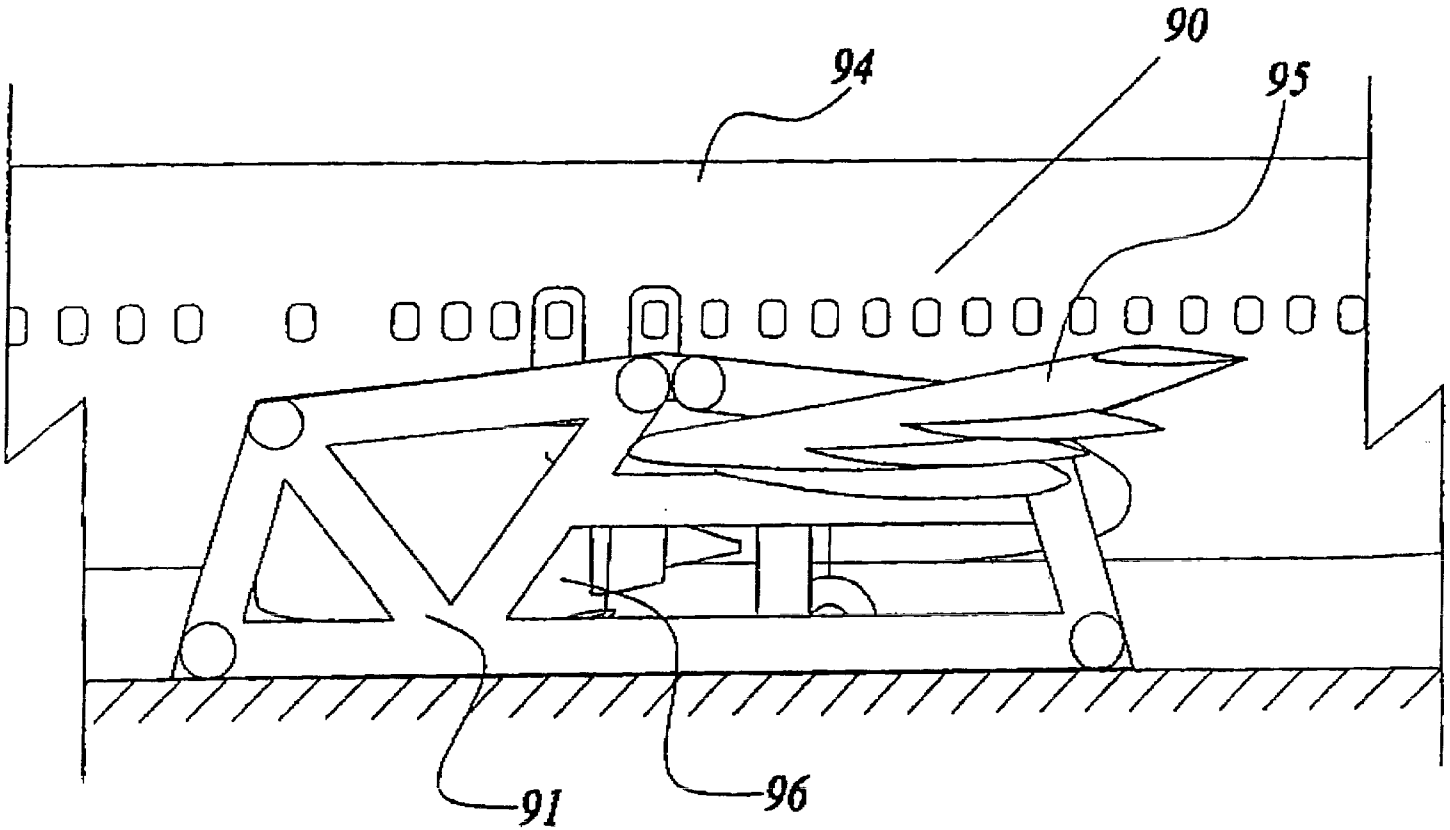
Figure 13:
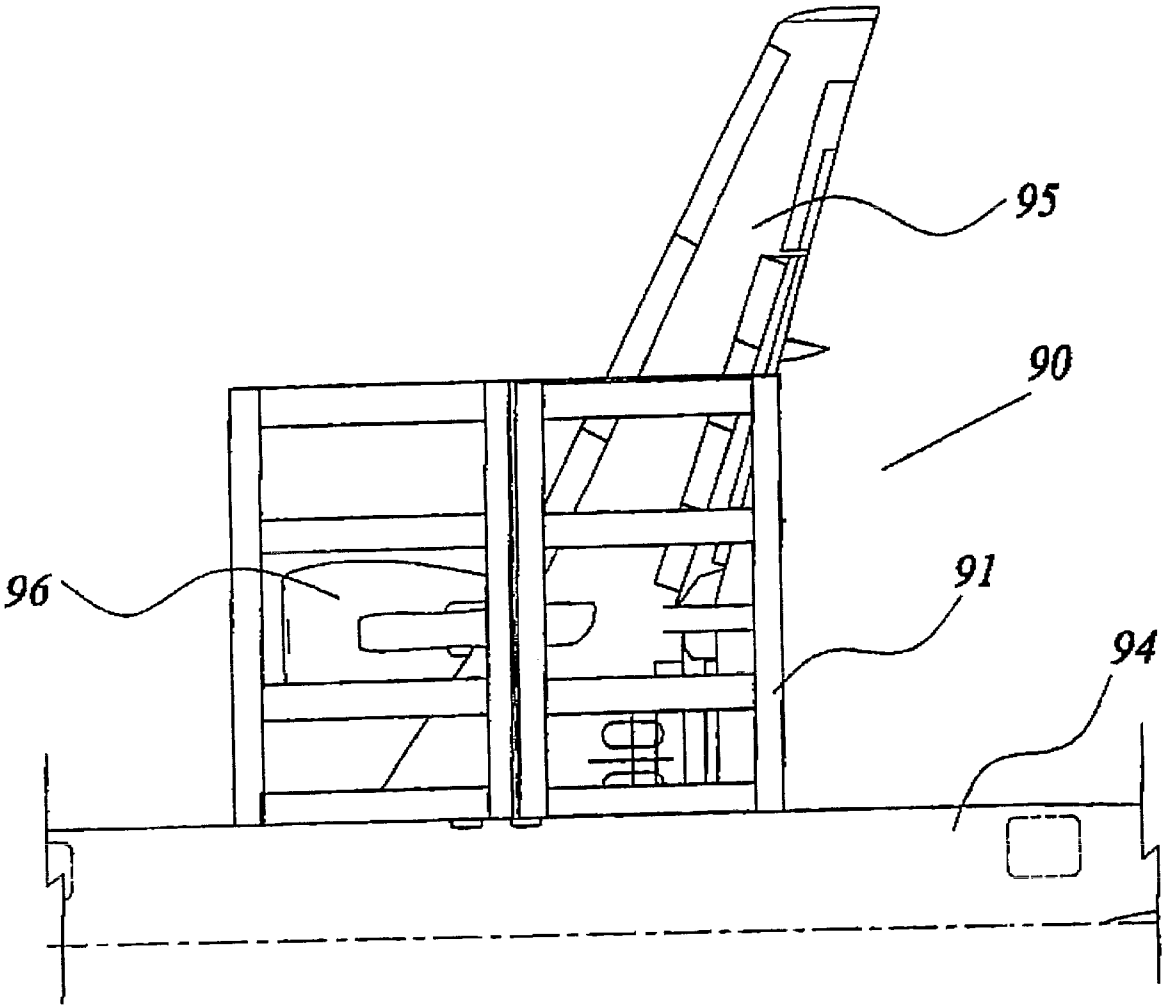
Figure 14:
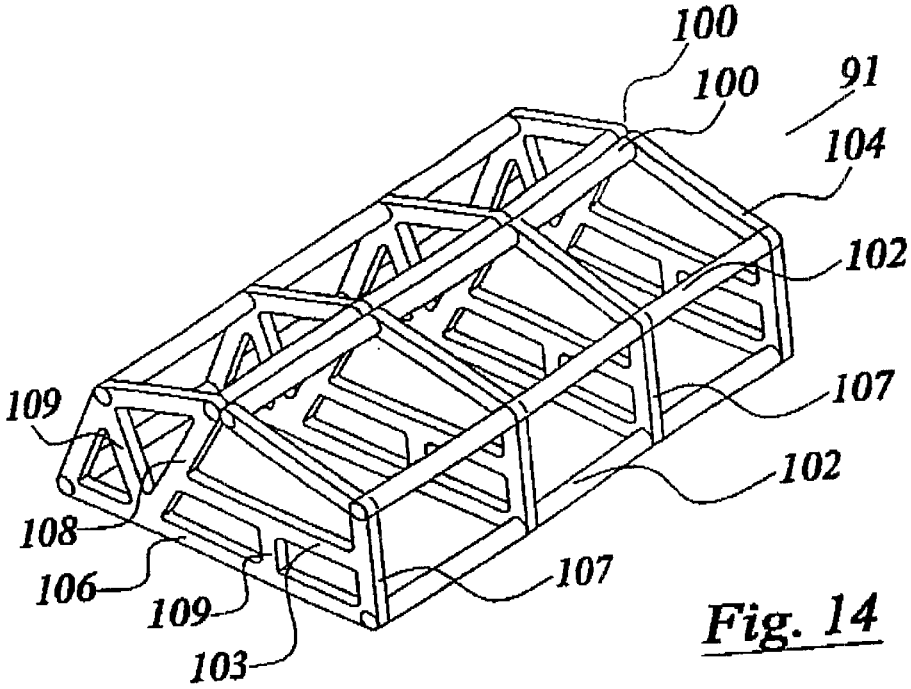
Figure 15:
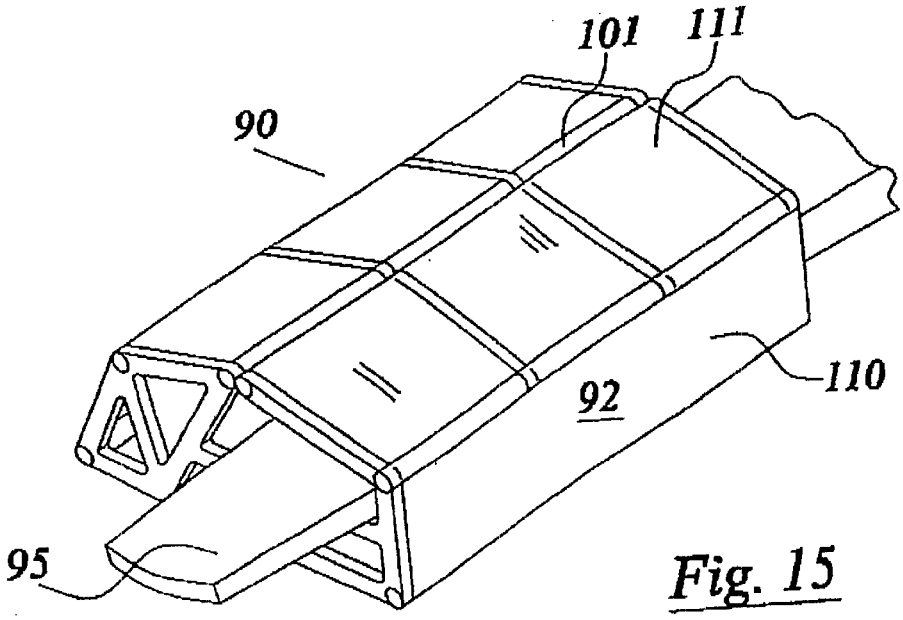
Figure 16:
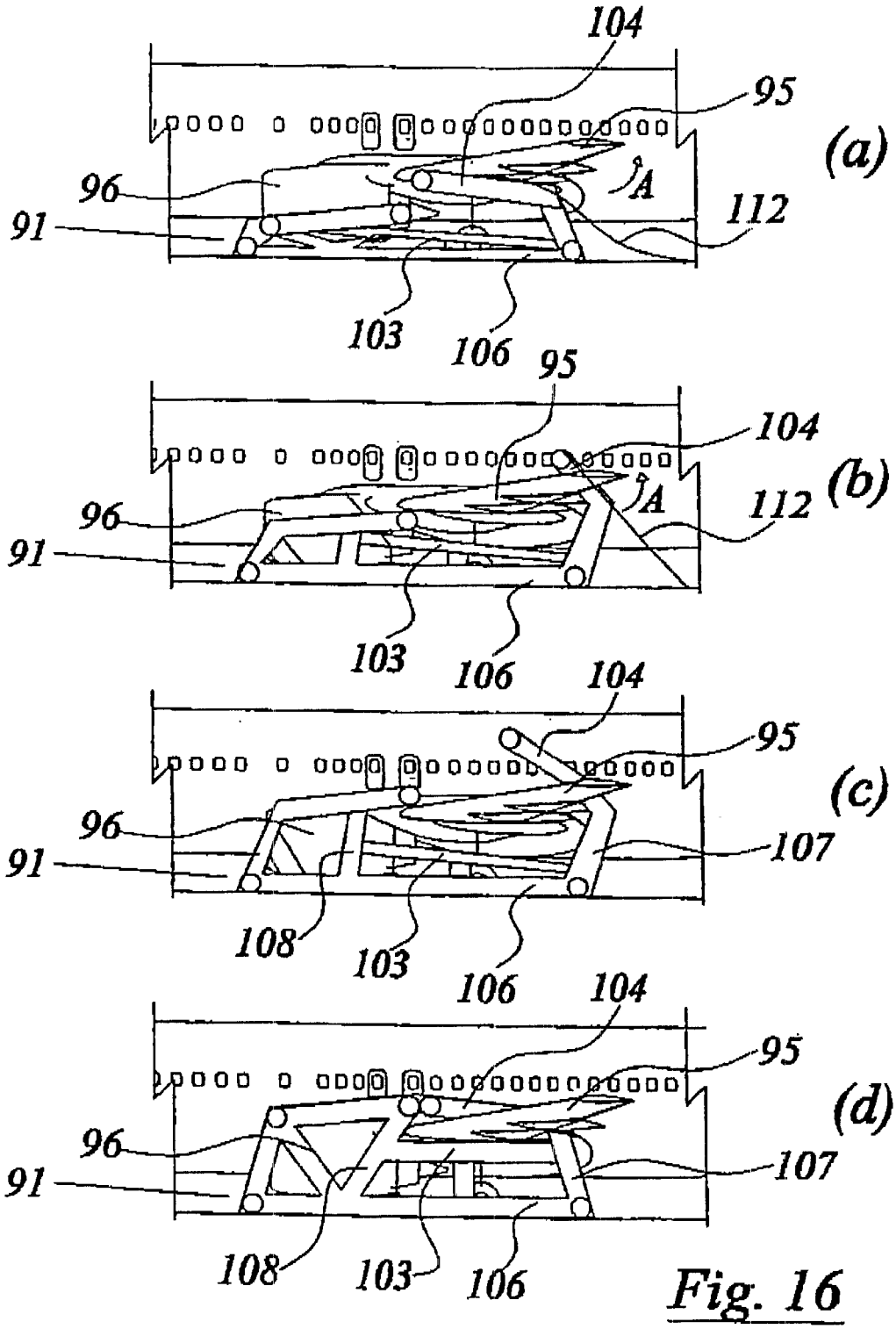
Figure 17:
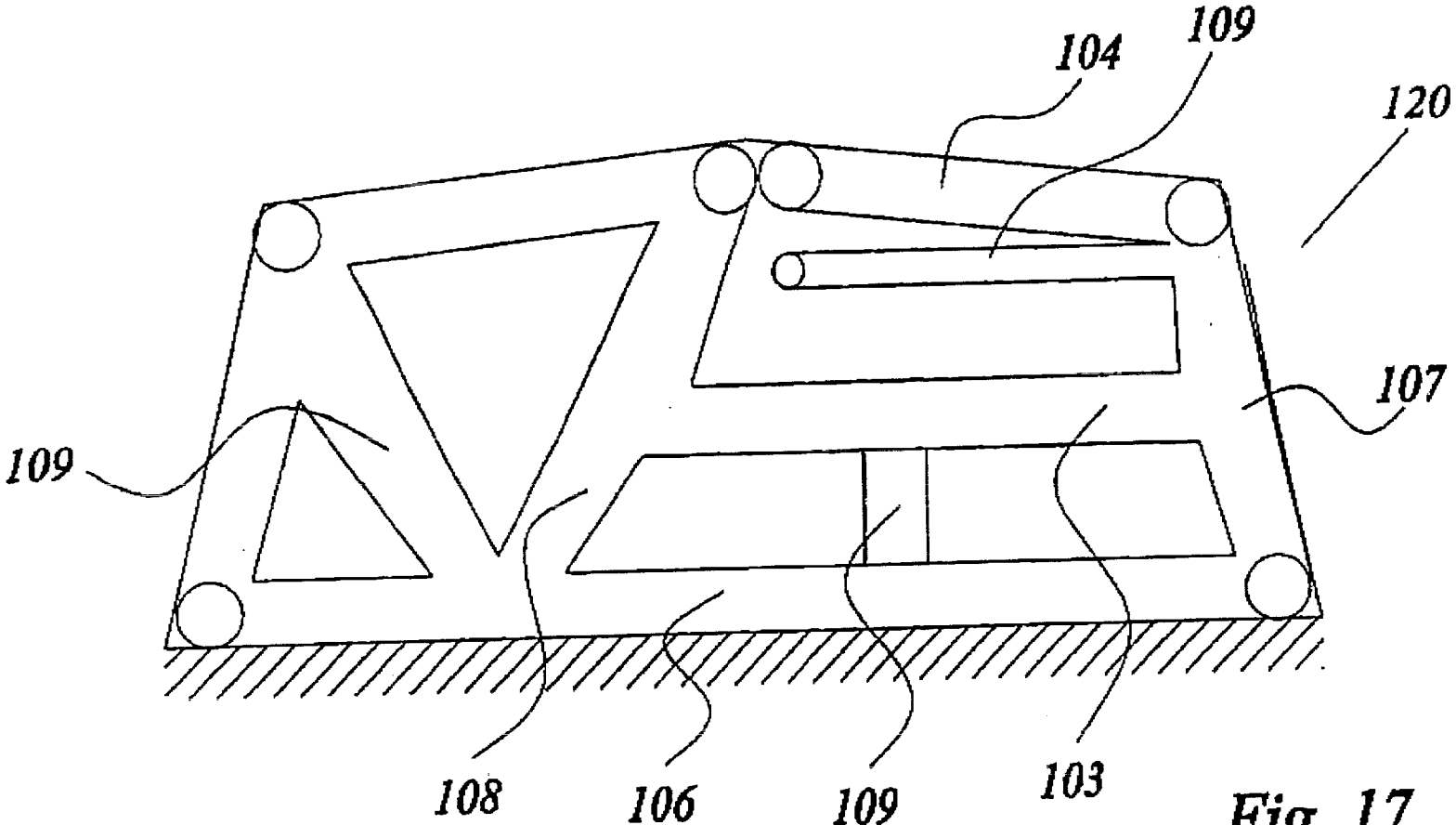

FIG. 10 is a perspective view of a still further structure according to the invention, FIG. 11 is an end view of a framework forming part of another shelter mounted on an aeroplane wing, FIG. 12 is a side view of the framework, FIG. 13 is a plan view of the framework, FIG. 14 is a perspective view of the framework standing alone, FIG. 15 is a perspective, view of the assembled shelter of FIGS. 11 to 14 on an aeroplane wing, FIGS. 16(*a*) to (*d*) show in diagrammatic sectional form assembly of the shelter, and FIG. 17 shows in diagrammatic form similar to FIG. 16(*d*) an alternative construction of framework.

Referring to the drawings and initially to FIGS. 1 and 2 there is provided a temporary shelter which is only illustrated fully assembled in FIG. 2(*d*) and identified by the reference numeral 1. The shelter 1 comprises a framework work indicated generally by the reference number 2 illustrated in FIG. 1 and FIGS. 2(*a*) to 2(*c*). The framework 2 comprises a plurality of longitudinally arranged frame members 3 and two longitudinally arranged elongate bearing frame members 4 forming a spine indicated by the reference numeral 5 having side edge 6. In this embodiment the spine 5 forms the ridge of the building. The shelter can in the absence of another structure, be inflated so that the facing elongate bearing members 4 will contact each other as illustrated in FIG. 1, closing spine 5. A plurality of intermediate accurately arranged transverse members 7 complete the framework. The frame members 3, 4 and 5 are made of a suitable pliable hollow inflatable material and an air inlet 8 is provided for inflation of the structure. A number of deflation valves 9 are mounted along the elongate bearing frame members 4. It will be noted that only some of the transverse members 7 project the whole way across the structure. A suitable covering 9(*a*) of any flexible material is provided, only portion of which is shown, and openings, etc., to allow ventilation, access and so on may be provided in the covering material 9(*a*), most of which will in practice be permanently fixed to the frame members 3, 4 and 5.

To erect the shelter 1 to enclose an aircraft engine pod, reference is now made to FIGS. 2(*a*) to (*d*) where there is illustrated portion of an aircraft wing 10 having suspended therefrom an engine pod 11 by a narrow pylon 17. To erect the shelter 1 the framework 2 is laid in a deflated condition beneath the engine pod 11 and is gradually inflated until the bearing frame members 4 impinge against the bottom of the pod 11. It will be appreciated therefore that the bearing frame members moving apart open the spine 5 to allow it subsequently bear by its side edges 6 against the narrow pylon 17. While this suggests that the frame member 2 will by inflation position itself over the engine pod, this may not always be the case and it will be appreciated that a certain amount of manipulation may be required. However, most of the shelter can be inflated to be substantially in position before manipulation is required. Further inflation (see FIG. 2(*b*)) causes the ridge members 4 to move apart in the direction of the arrows A, while still contacting the pod 11. Further inflation of the framework 2 causes the ridge members 4 to rise above the pod 11 and to then under the natural resilience of the framework to move inwards in the direction of the arrows B (see FIG. 2(*c*)) to engage against the pylon 17. The engine pod 11 is now encapsulated within the framework 2 and the covering can be placed on the framework 2 as illustrated in FIG. 2(*d*) if not already in situ.

Generally on deflation the shelter 1 will collapse, however, in many instances it might collapse and not deflate. It is unlikely that it would, happen in, for example, the situation envisaged in FIG. 2 but it is always a possibility. Where the shelter lies over a considerable amount of the structure then it is possible on deflation that air would still be trapped in the upper portions of the shelter adjacent the spine and thus further deflation would be required. Thus the use of deflation valves such as illustrated could be important. It is also envisaged that such deflation valves could be remotely operated by use of suitable battery powered, for example, electronic equipment.

It is envisaged that as well as erecting the framework first and then placing the cover on top of the framework the cover may be placed or loosely affixed to portions of the framework 2 prior to assembly. The advantage of this is that for example a cover could be affixed to each longitudinal frame member 3 by and adhesive or other attachment and then as the temporary structure is inflated the cover would gradually be stretched.

Additionally, in operation instead of inflating the framework 2 around the engine pod 1 as described above, the two bearing frame members 4 may be first placed on either side of the pylon 17 and at least far enough above the engine pod 11 to be above its widest portion, so that on inflation the framework 2 will simply expand upwards when the ridge members 4 will engage the pylon 17.

Referring now to FIG. 3 there is illustrated an alternative construction of frameworks indicated generally by the reference numeral 20 in which parts similar to those described with reference to FIGS. 1 and 2 are identified by the same reference numerals.

In this embodiment there are no bearing frame members 4 but there are provided instead some additional intermediate arcuate in-line transverse frame members in the form of elongate pairs of frame members 21 comprising spine forming frame members having ends 22 facing each other. In operation, the spine forming frame members 21 will effectively bear against each other to provide clear anchorage of the spine on a structure such as an engine pod.

Referring now to FIG. 4, there is illustrated an alternative construction of shelter indicated generally by the reference numeral 30 which shows a structure substantially similar in construction to the structure illustrated in FIGS. 1 and 2 except that in this embodiment there is provided peripherally arranged extension walls 31 of a flexible material which is provided to accommodate different heights of structure above the ground such as illustrated in this embodiment by an engine pod 11. It will be seen how the extension walls 31 can be turned out on themselves at 32 to support weights 33 to further provide anchorage of the shelter 30. The weights 33 could, for example, be equipment used for the maintenance, etc. Needless to say the extension walls could also be turned inwards.

Referring now to FIG. 5, there is illustrated in section an alternative construction of bearing frame member indicated generally by the reference numeral 35 which comprises an elongate tubular member having narrowed portions forming in effect hinges 36 to allow the bearing frame member 35 to accommodate different shapes of structure against which it is mounted. This bearing frame member 35 will allow the spine of the shelter to accommodate many forms of structure.

Referring now to FIG. 6, there is illustrated a still further construction of bearing frame member indicated generally by the reference numeral 40. In this embodiment the bearing frame member 40 comprises a plurality of separate frame members 41 connected by extension sheet material 42. The extension sheet material 42 will permit obviously the pivoting of one frame member 41 relative to the other frame member 41 but will also allow the peripheral dimensions of the spine portion of the shelter to expand to accommodate the structure.

Referring now to FIG. 7, there is illustrated as still further construction of bearing frame member indicated by the reference numeral 50 identical in all respects to the bearing frame member 4, described with reference to FIGS. 1 and 2, except that in this embodiment the bearing frame member 50 is covered an its spine side edge forming surface by a sheet of resilient material 51 in this embodiment a foamed plastics material.

Referring now to FIGS. 8(*a*) and (*b*), there is illustrated an alternative construction of transverse frame member indicated generally by the reference numerals 70 of substantially tubular construction provided with a number of connectors in the form of eyes 71 and a length of cord 72. As can be seen from FIG. 8(*b*) with the cord 72 threaded through the eyes 71 and lightened down, the length of the frame member 70 can be reduced and thus the framework can be adapted to various heights of aeroplane wing and this will in many instances be a better construction of frame member to achieve the same object as the shelter 30 illustrated in FIG. 4

Referring now to FIG. 9, there is illustrated a shelter indicated generally by the reference numeral 6 having an open spine 61 and an entrance door 62. The shelter 60 is a conventional inflatable shelter in this embodiment made from a plurality of inflatable panels as is conventional but which are not shown. Mounted on either side of the shelter 60 are two elongate flexible containers 63 having a water inlet 64 and a water outlet 65. It will be appreciated that ballast water may be introduced into the container 63 to secure the shelter 60 in situ. It will be appreciated that any other form of ballast material could be used.

Referring now to FIG. 10, there is illustrated an alternative construction of shelter indicated generally by the reference numeral 80. In this embodiment there is provided a spine which is formed from a pair of arcuate elongate facing bearing members, not shown, which together form on inflation a structure receiving hold 81 having side edge faces 82. On the exterior of the shelter 80 are provided anchorage hooks 83. The anchorage hooks 83 can be used to connect stay wires 84 thereto which stay wires 84 can be anchored on the ground by, for example, sandbags 85. This would be particularly advantageous in high wind conditions. The hole 81 will be particularly suitable for use with structures where it is not possible for the shelter to close in on itself to encapsulate portion of the structure therein. A typical example of this would be where the structure being enclosed does not have a narrowing portion or neck behind it suitable for anchorage of the shelter. Certain aeroplanes have their engines flush with the wings which engines are often covered by gull-wing type doors which doors open out to bear often closely against the underneath of the wing. In such situations it would not be possible for a shelter according to the present invention to be anchored behind the engine pod as such but the shelter will have to impinge probably against the underneath of the wing or, indeed, maybe against the open gull-wing door.

Referring now to FIGS. 11 to 15 inclusive, there is illustrated a shelter which is only illustrated fully in FIG. 15 and is indicated in this drawing by the reference numeral 90. The shelter 90 comprises a framework indicated generally by the reference numeral 91 which is normally almost completely covered by a flexible covering material 92, again, only illustrated in FIG. 15. The shelter 90 and framework 91 are illustrated in some of the drawings mounted on an aeroplane 94 having a wing 95 mounting an engine pod 96 which is substantially flush therewith.

The framework 91 comprises two longitudinal elongate bearing frame members 100 forming portion of a spine 101 shown closed additional elongate frame members 102 transverse frame members namely upper transverse frame members 104, intermediate transverse frame members 105, base transverse frame members 106, upright transverse frames members 107, an inner upright frame members 108 and additional reinforcing strut frame members 109.

The framework 91 when carrying the covering material 92 forms what is in effect four upstanding substantially rectangular side walls 110 (see. FIG. 15) and a roof 111 bridging the side walls 110. The spine 101 projects effectively across the roof 111 between the two elongate bearing frame members 100 and then down across opposite side walls 110 between the upper transverse frame member 104 and the intermediate transverse frame member 105 and also between one of the struts 107 as can be seen clearly in FIG. 14. The latter part forming a large wing receiving hole.

To erect the shelter reference is now made to FIG. 16. In FIG. 16(*a*) the shelter 90, though only the framework 91 is illustrated, is placed beneath the engine pod 96 and a rope 112 is connected to the bearing frame member 100. The framework 91 is inflated and will gradually rise towards the wing 95 as illustrated in FIG. 16(*b*). By this stage the frame member 100 has been pulled back in the direction of the arrow A (see FIG. 16(*a*)) so that it slips round the top of the wing 95 on further inflation. The shelter is then fully inflated so that the two bearing frame members 100 approach each other in the direction of the arrow B as illustrated in FIG. C until they assume the position illustrated in FIG. D. It will be seen then that the aeroplane wing 95 projects through the side walls 110 of the shelter 90 storing the engine pod 96 securely therein. It will also be appreciated that there will have to be sufficient openings in the covering material 92 to accommodate the wing projecting therethrough.

Referring now to FIG. 17, there is illustrated an alternative construction of framework indicated generally by the reference numeral 120 with parts similar those described with reference to FIGS. 11 to 16 inclusive are identified by the same reference numerals. In this embodiment there is an additional cantilevered upper intermediate transverse frame member 109 which is so configured as to lie in use along the wing 95. It will be appreciated that this construction will ensure a tight bearing of the spine on the aeroplane wing 95.

It is envisaged that the covering may be provided by a plurality of different sheets joined together by suitable fastening means, for example, a zip fastener, hook and eye fasteners such as those sold under the Trade Mark VELCRO, or any other suitable means. The advantage of providing the cover in a number of sheets is that it will not be necessary to replace the whole cover when one portion of it is torn.

It will also be appreciated that the cover may incorporate windows, doors or other openings required for example to allow the supply of services therethrough such as power cables, water lines and the like.

It will be appreciated that a temporary shelter according to the present invention has an advantage that has not hitherto been considered with such temporary structures, namely the ability to encapsulate not all of the unit such as a building or a piece of machinery like an aeroplane, but simply to be able to enclose portion of it sufficient to allow work or other services to be provided. A relatively small portable structure may be provided.

A particular advantage of the present invention that has been mentioned already and may be repeated lies in the fact that it can be placed in situ beneath, for example, an aeroplane wing and then relatively easily inflated into position. Thus it does not require any great work or effort by those using the shelter to place it in position. This is also something that can be relatively easily and quickly placed in position and this is of major importance during maintenance operations on aeroplanes, for example, where time is of the essence.

In the specification the terms "comprise, comprises, comprised and comprising" are used interchangeably with the terms "include, includes, included and including" and are to be afforded the widest possible interpretation and vice versa.

The invention is not limited to the embodiment hereinbefore described, but may be varied in both construction and detail within the scope of the claims.

What is claimed is:

1. An inflatable temporary work shelter for a structure, the work shelter comprising walls, at least a portion of which is inflatable to allow the walls, on inflation, to be free-standing, each wall comprising a lower ground engaging portion and an upper inflatable portion forming a framework of inflatable, interconnected frame members including a spine having side edges which, upon inflation of the upper portion of each wall, encloses a portion of the structure within the work shelter.

2. A shelter as claimed in claim 1, in which portion of the walls are joined together.

3. A structure as claimed in claim 1, wherein a portion of the side edges includes faces that contact each other intermediate their ends to accommodate a portion of the structure projecting therethrough.

4. A shelter as claimed in claim 1, wherein covering material is attached to the framework formed, the spine being provided by two adjacent facing elongate bearing frame members.

5. A shelter as claimed in claim 4, in which the two elongate bearing frame members are configured to contact each other firmly on inflation when the structure is not encapsulated therein.

6. A shelter as claimed in claim 1 in which the spine comprises a pair of arcuate elongate facing bearing frame members forming on inflation a structure receiving hole, the side faces being urged on inflation to contact the structure.

7. A shelter as claimed in claim 6, in which the two elongate bearing frame members are configured to contact each other firmly on inflation when the structure is not encapsulated therein.

8. A shelter as claimed in claim 4, wherein each of said two adjacent-facing elongate bearing frame members includes at least one hinge portion intermediate its length for limited pivotal movement about itself.

9. A shelter as claimed in claim 8, in which the two elongate bearing frame members are configured to contact each other firmly on inflation when the structure is not encapsulated therein.

10. A shelter as claimed in claim 4, in which each of said two adjacent-facing elongate bearing frame members comprises a plurality of separate frame members interconnected by flexible extension sheet material to permit extension of the peripheral dimensions of the spine portion to accommodate the structure.

11. A shelter as claimed in claim 10, in which the two elongate bearing frame members are configured to contact each other firmly on inflation when the structure is not encapsulated therein.

12. A shelter as claimed in claim 10, in which the spine comprises a pair of elongate in-line transverse frame members, each frame member terminating in an end portion bearing against one of the side edge faces, the two end portions facing each other from opposite side edge faces.

13. A shelter as claimed in claim 1, in which the spine is located against the uppermost portion of the shelter when inflated whereby on being placed beneath a structure and inflated the shelter will contact the underneath of the structure and force the side edge faces apart to encompass portion of the structure.

14. A shelter as claimed in claim 1 incorporating elongate frame members of substantially tubular flexible material and having on the exterior thereof anchorages, and a connecting means for securing in line anchorages together to varying the length of the frame member.

15. A shelter as claimed in claim 1, in which the side edges of the spine incorporate a resilient material.

16. A shelter as claimed in claim 15, in which the resilient material is a foamed plastics material.

17. A shelter as claimed in claim 1, wherein the lower ground-engaging portion of each wall includes peripherally arranged extension walls of flexible material to accommodate different heights of the structure above the ground.

18. A shelter as claimed in claim 1 in which the side walls incorporate containers for ballast anchoring material.

19. A shelter as claimed in claim 18, in which the ballast anchoring material is water.

20. A shelter as claimed in claim 1 in which there is provided connectors on the exterior thereof for connection to stay wires.

21. A shelter as claimed in claim 1 in which there are a plurality of deflation valves adjacent the spine.

22. A shelter as claimed in claim 1 in which the walls are substantially arcuate in shape and the spine forms a central ridge for enclosing an aircraft engine pod mounted on the aircraft wing.

23. A shelter as claimed in claim 1 in which the shelter walls comprise four upstanding substantial rectangular side walls and a flat covering wall providing a roof and a spine extending from one side wall across the roof to the opposite side wall for an aircraft wing to project therethrough.

24. A shelter as claimed in claim 1, in which the remainder of each side edge engages another side edge to form an enclosed shelter.

25. An inflatable temporary work shelter for a structure, the work shelter comprising walls, at least a portion of which is inflatable to provide an upright framework, inflatable structure-receiving means on an upper portion of the walls comprising an opening having a peripheral side edge, the side edge, upon inflation, bearing against a portion of the structure to form an enclosed shelter while encompassing the portion of the structure.

26. A shelter as claimed in claim 25, in which the remainder of each side edge engages another side edge to form an enclosed shelter.

27. A shelter as claimed in claim 25, in which portion of the walls are joined together.

28. An inflatable temporary work shelter for encompassing a projecting part of another structure comprising two opposed side walls, at least portion of which are inflatable to allow the walls, on inflation, to be free standing, each side wall comprising a lower ground engaging portion and an upper portion defining a side edge, the side edges, on inflation mating together above the side walls to cover the part therebelow; in which at least one projecting part receiving inlet is formed in the shelter for reception of the part, the side walls bearing against the part around the periphery of the inlet.

29. A shelter as claimed in claim 28, in which there is a projecting part receiving outlet to allow the part project through the shelter.

30. An inflatable temporary work shelter for an aeroplane engine pod comprising:

walls, at least portion of which are inflatable to provide an upright structure, and an engine pod receiving means in the walls comprising an opening having a peripheral side edge, the side edge, on inflation, bearing against portion of the aeroplane to form therewith an enclosed shelter while encompassing the engine pod.

31. An inflatable temporary work shelter for encompassing portion of the wing of an aeroplane comprising two opposed side walls, at least portion of which are inflatable to allow the walls, on inflation, to be free standing, each wall comprising a lower ground engaging portion and an upper portion defining a side edge, the side edges, on inflation, mating together above the wing, at least one wing receiving inlet is formed in the shelter for reception of the wing, the side edges mating with the wing to form a seal around the periphery of the inlet.

32. A shelter as claimed in claim 31 in which there is a wing receiving outlet to allow the wing project through the shelter, the side edges mating with the wing to form a seal around the periphery of the outlet.

33. An inflatable temporary work shelter for another structure comprising walls, at least a portion of which is inflatable to allow the walls, on inflation, to be free-standing, each wall comprising a lower ground-engaging portion and an upper portion having side edges, at least a portion of the side edges forming a spine for engaging the structure on inflation to enclose a portion of the structure within the shelter, the shelter further including peripherally arranged extension walls of flexible material to accommodate different heights of the structure above the ground.

34. An inflatable temporary work shelter for another structure comprising walls, at least a portion of which is inflatable to allow the walls, on inflation, to be free-standing, each wall comprising a lower ground-engaging portion and an upper portion having side edges, at least a portion of the side edges forming a spine for engaging the structure on inflation to enclose a portion of the structure within the shelter, wherein the side walls incorporate containers for ballast-anchoring material.

35. An inflatable temporary work shelter for another structure comprising walls, at least a portion of which is inflatable to allow the walls, on inflation, to be free-standing, each wall comprising a lower ground-engaging portion and an upper portion having side edges, at least a portion of the side edges forming a spine for engaging the structure on inflation to enclose a portion of the structure within the shelter, wherein a plurality of deflation valves are disposed adjacent the spine.

36. An inflatable temporary work shelter for another structure comprising walls, at least a portion of which is inflatable to allow the walls, on inflation, to be free-standing, each wall comprising a lower ground-engaging portion and an upper portion having side edges, at least a portion of the side edges forming a spine for engaging the structure on inflation to enclose a portion of the structure within the shelter, wherein the shelter walls comprise four upstanding, substantially rectangular side walls and a flat covering wall providing a roof and a spine extending from one side wall across the roof to the opposite side wall for an aircraft wing to project therethrough.

* * * * *